US012378745B2

(12) United States Patent
Fernandes

(10) Patent No.: US 12,378,745 B2
(45) Date of Patent: Aug. 5, 2025

(54) RADON GAS MITIGATION SYSTEM AND KIT FOR A BUILDING WITH A CRAWLSPACE

(71) Applicant: Joao Pascoa Fernandes, Winnipeg (CA)

(72) Inventor: Joao Pascoa Fernandes, Winnipeg (CA)

( * ) Notice: Subject to any disclaimer, the term of this patent is extended or adjusted under 35 U.S.C. 154(b) by 232 days.

(21) Appl. No.: 18/329,248

(22) Filed: Jun. 5, 2023

(65) Prior Publication Data

US 2023/0392344 A1 Dec. 7, 2023

Related U.S. Application Data

(60) Provisional application No. 63/348,642, filed on Jun. 3, 2022.

(51) Int. Cl.
*E02D 31/00* (2006.01)

(52) U.S. Cl.
CPC ..... *E02D 31/008* (2013.01)

(58) Field of Classification Search
CPC ..... E02D 31/008; F24F 2110/68
See application file for complete search history.

(56) References Cited

U.S. PATENT DOCUMENTS 4,905,579 A * 3/1990 Dame ..... E02D 31/008 250/DIG. 2
4,938,124 A * 7/1990 Garza ..... E02D 31/008 454/339
5,083,500 A * 1/1992 Francis ..... B08B 9/0495 454/341
5,158,501 A * 10/1992 Proskiw ..... E02D 31/008 454/341
5,551,797 A * 9/1996 Sanford ..... E02D 31/02 454/909
6,543,189 B1 * 4/2003 Wood, Jr. ..... E02D 31/008 52/302.1
2005/0191956 A1 * 9/2005 Doyle ..... E02D 31/008 454/253
2009/0183444 A1 * 7/2009 Wilkerson ..... E02D 31/008 52/273

FOREIGN PATENT DOCUMENTS

EP 2557234 A2 * 2/2013 ..... E02D 31/008

* cited by examiner

*Primary Examiner* — Adriana Figueroa
(74) *Attorney, Agent, or Firm* — Ryan W. Dupuis; Michael R. Williams; Ade & Company Inc.

(57) ABSTRACT

A radon gas mitigation system and kit for a building with a crawlspace comprises a plurality of radon gas intakes arranged under a vapor barrier in the crawlspace to be in a subterranean environment and outside a building envelope. The intakes are arranged to be respectively registered with one of plural foundation walls and collectively arranged to generally follow the building footprint. The intakes are arranged in spaced relation to the foundation walls. A manifold is arranged in the building envelope and in fluidic communication with the intakes; a fan in the building envelope and in fluidic communication with the manifold and configured to generate an airflow to draw radon gas from the subterranean environment and to the manifold; and an outlet arranged in the building at a location above a grade of ground and in fluidic communication with the manifold and configured to release the radon gas to the outside.

18 Claims, 5 Drawing Sheets

RADON GAS MITIGATION SYSTEM AND KIT FOR A BUILDING WITH A CRAWLSPACE

This application claims the benefit under 35 U.S.C. 119(e) of U.S. Provisional application Ser. No. 63/348,642 filed Jun. 3, 2022.

FIELD OF THE INVENTION

The present invention relates generally to a radon gas mitigation system and kit for a building with a crawlspace, and more particularly to such a system and kit comprising a plurality of distinct lengths of perforated piping acting as radon gas intakes.

BACKGROUND

It is well known that a crawlspace of a building can be a major source of radon and moisture entry into the building. In high concentrations, radon can pose a significant, long-term health hazard to occupants of the building while moisture can cause damage to the house and lead to mould development, rotting of moisture-susceptible materials and general degradation of the indoor environment.

SUMMARY OF THE INVENTION

According to an aspect of the invention there is provided a radon gas mitigation system for use in a building, wherein the building has an in-ground foundation configured to be supported by ground material and defining a building footprint, wherein the building includes an enclosed structure supported on the foundation, wherein the foundation has a plurality of upstanding walls with bottom ends disposed below a below-grade surface of the ground material within the building footprint and top ends of the walls disposed above a grade-defining surface of the ground material outside the building footprint, wherein the building includes a substantially horizontal floor supported by the foundation adjacent to and at a spaced height above the below-grade surface, wherein the floor forms a crawlspace thereunder and between the foundation walls and the below-grade surface of the ground material, wherein the building further includes a vapor barrier in the crawlspace and arranged in contact with the ground material to form a subterranean environment under the vapor barrier and a substantially enclosed building envelope thereabove, the radon gas mitigation system comprising:

- a plurality of radon gas intakes arranged under the vapor barrier so as to be disposed in the subterranean environment, wherein each radon gas intake is in the form of a length of piping having a tubular peripheral wall and extending between first and second ends, wherein the first and second ends are closed, wherein the peripheral wall has a plurality of openings configured to permit passage of fluid into the piping;
- wherein the radon gas intakes are arranged to be respectively registered with one of the walls of the foundation and are collectively arranged to generally follow the building footprint, and wherein the radon gas intakes are arranged in spaced relation to the walls of the foundation;
- a manifold arranged above the vapor barrier so as to be within the building envelope, wherein the manifold is in fluidic communication with the radon gas intakes;

- a fan arranged within the building envelope and in fluidic communication with the manifold, wherein the fan is configured to generate an airflow to draw the radon gas from the subterranean environment and to the manifold; and
- an outlet arranged in the building at a location thereon above the grade-defining surface of the ground material, wherein the outlet is in fluidic communication with the fan and configured to release the radon gas to an outside environment of the building envelope.

This arrangement is particularly suited for removing radon gas from buildings with crawlspace, in particular crawlspaces under in-ground basements.

In the illustrated arrangement, the manifold is arranged to be located in the crawlspace.

Preferably, in such an arrangement, the manifold is arranged to be mounted to an underside of the floor.

In the illustrated arrangement, the manifold is arranged substantially centrally of the building footprint.

In the illustrated arrangement, the fan is arranged to be located outside the crawlspace.

In the illustrated arrangement, the system further includes respective ducting from each of the radon gas intakes to the manifold and arranged to convey the drawn radon gas, and the respective ducting extends upwardly from a respective one of the radon gas intakes and then substantially horizontally to the manifold.

Preferably, in such an arrangement, a horizontal portion of the respective ducting that extends horizontally to the manifold is arranged to be supported by the floor.

In the illustrated arrangement, the manifold and the radon gas intakes are arranged substantially symmetrically of a center of the building footprint.

In the illustrated arrangement, opposite ones of the radon gas intakes are substantially the same.

According to another aspect of the invention there is provided a kit for the radon gas mitigation system.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
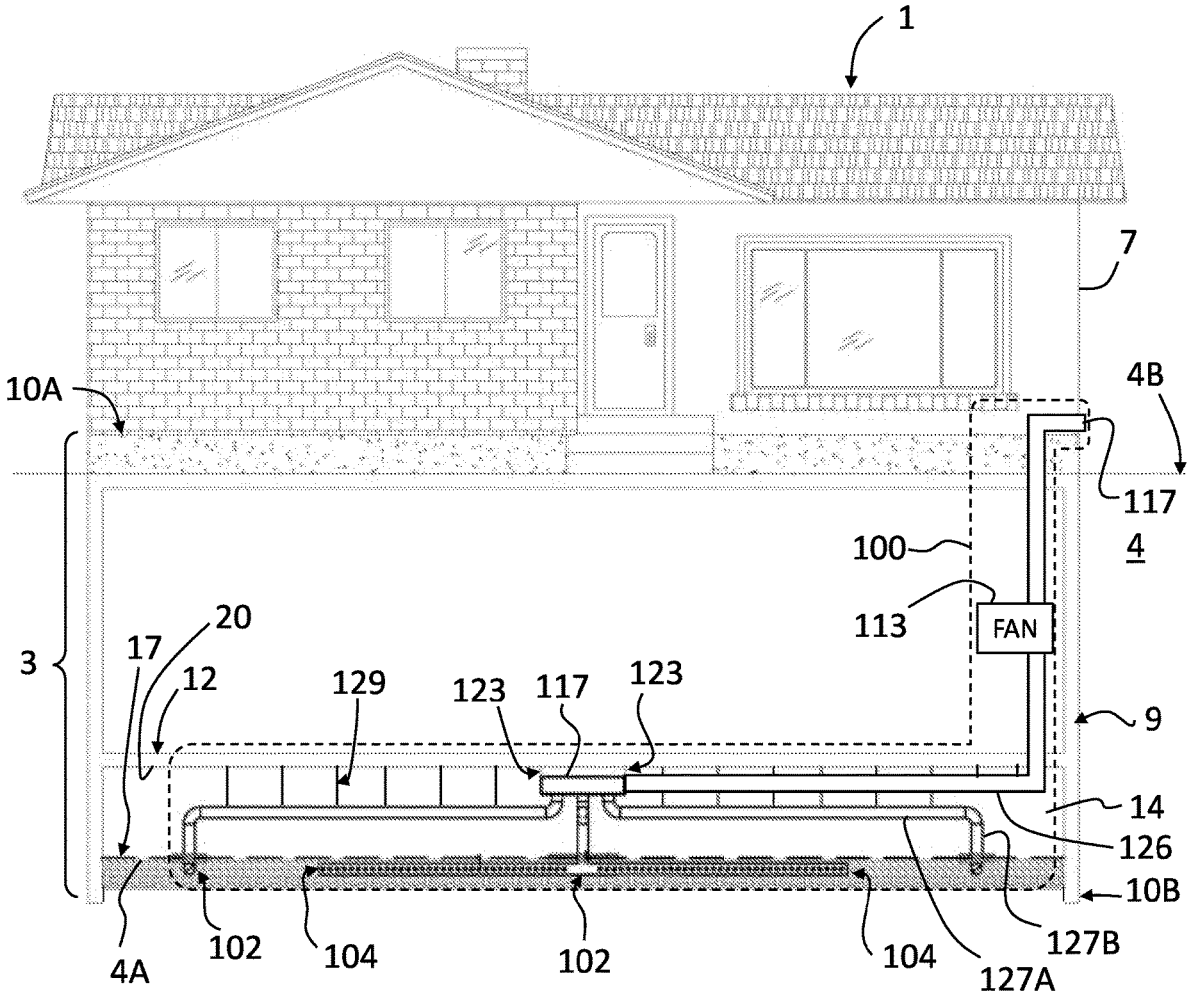
FIG. 1 is a schematic diagram of a building with an arrangement of radon gas mitigation system installed therein.

The accompanying figures show a radon gas mitigation system 100 for use in a building 1, for example a house. The radon gas mitigation system is suited for collecting gaseous fluid, which may carry radon and moisture (that is, water vapor), from a subterranean environment under the building and venting the same out of the building.

Generally speaking, the building 1 has an in-ground foundation 3 configured to be supported by ground material 4 and defining a building footprint 5, and an enclosed structure 7 supported on the foundation 3. The enclosed structure 7 is disposed substantially above ground, and typically fully above ground, as in the illustrated arrangement.

The foundation 3 has a plurality of upstanding walls 9 with bottom ends 10A disposed below a below-grade surface 4A of the ground material within the building footprint 5 and top ends 10B of the walls 9 disposed above a grade-defining surface 4B of the ground material 4 outside the building footprint 5. The upstanding foundation walls delimit the building footprint 5.

Furthermore, the building 1 includes a substantially horizontal floor 12 supported by the foundation 3 adjacent to and at a spaced height above the below-grade ground surface 4A. The floor 12 forms a crawlspace 14 thereunder and between the foundation walls 9 and the below-grade surface 4B of the ground material. The floor 12 of the building that forms the crawlspace 14 is substantially horizontal in that it is more horizontally oriented than vertically oriented; typically, this floor is horizontal, such that rollable items placed thereon are not conduced to move by gravity. The floor 12 typically comprises a plurality of parallel spaced-apart support beams, such as joists, and sheathing or covering panels supported thereon to bridge spaces between tops of the joists and to form an upper support surface of the floor. Thus, an underside of the floor is formed by the beams or joists.

Yet further, the building 1 includes a vapor barrier 17 (shown in stippled line in FIG. 1) in the crawlspace 14 and arranged in contact with the ground material 4, that is with the below-grade surface 4B thereof, to form a subterranean environment under the vapor barrier and a substantially enclosed building envelope thereabove. The building envelope is substantially enclosed in that the structure 7 and the in-ground foundation 3 collectively form an interior environment which is substantially thermally and fluidically distinct from an exterior or ambient environment of the building. Typically, the interior environment includes only conditioned space in the building, and therefore does not include an attic space which is not conditioned. The vapor barrier 17 is typically in the form of a sheet of substantially fluid-impermeable material, such as plastics, which is connected to the inner sides of the upstanding foundation walls 9 in a fluid sealing manner, so as to substantially prevent passage of fluid from the subterranean environment and into the building envelope.

Since there exists a subterranean environment within the building footprint 5, which is intended to be fluidically sealed from the building envelope by the vapor barrier, gaseous fluid, such as radon and water vapor, emitted from the earth, may tend to collect underneath the building. This gaseous fluid may enter the building envelope through openings in the vapor barrier or at any sealing interfaces through breaks in respective seals. Thus, there is provided the radon gas mitigation system to evacuate the gaseous fluid emitted from the earth and residing or otherwise collecting beneath the building.

The radon gas mitigation system 100, which also acts to control moisture entry into the building envelope from the subterranean environment underneath the building, generally comprises a plurality of radon gas intakes 102 arranged under the vapor barrier 17 so as to be disposed in the subterranean environment. Each radon gas intake 102 is in the form of a length of piping having a tubular peripheral wall 103 and extending between first and second ends 104 which are closed. The peripheral wall 103 has a plurality of openings 106 configured to permit passage of fluid into the piping.

Figure 2:
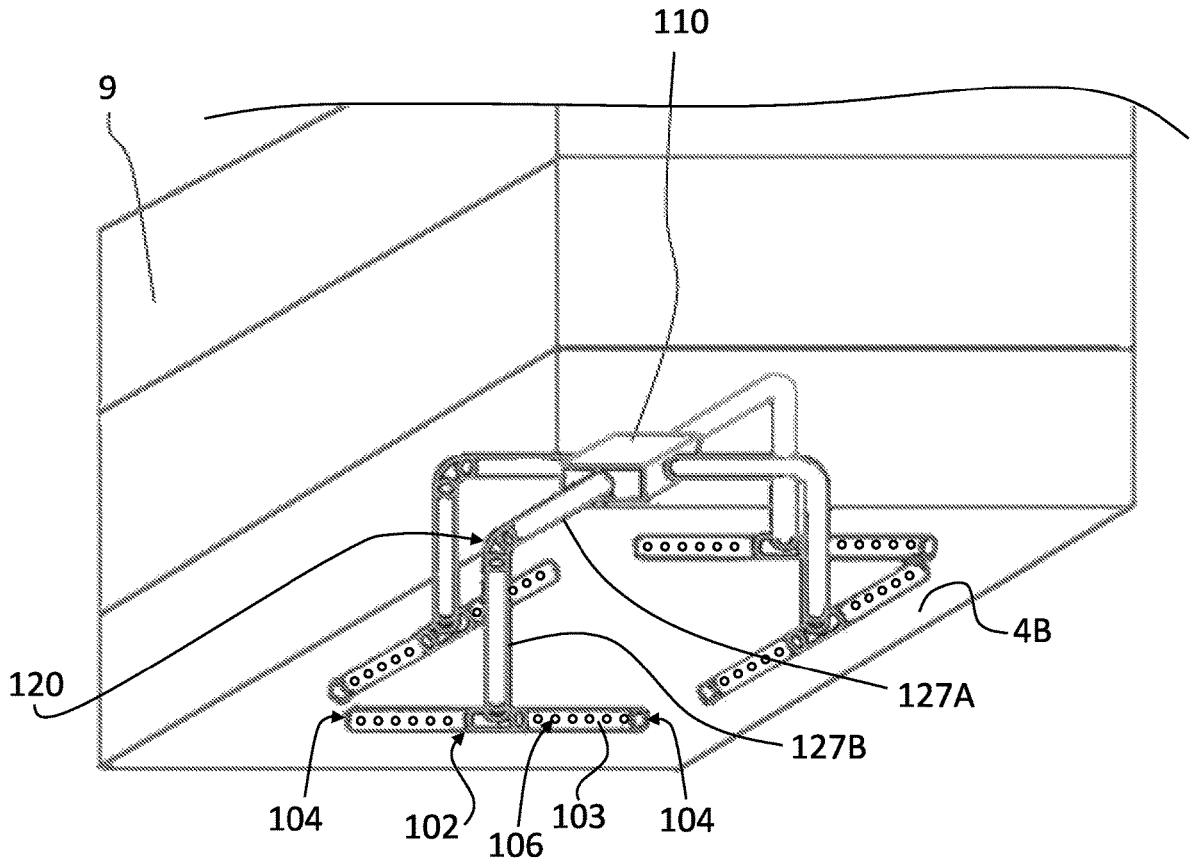
FIG. 2 is a perspective view schematically showing radon gas intakes, a manifold and interconnecting ducting of the system of FIG. 1.
Figure 3:
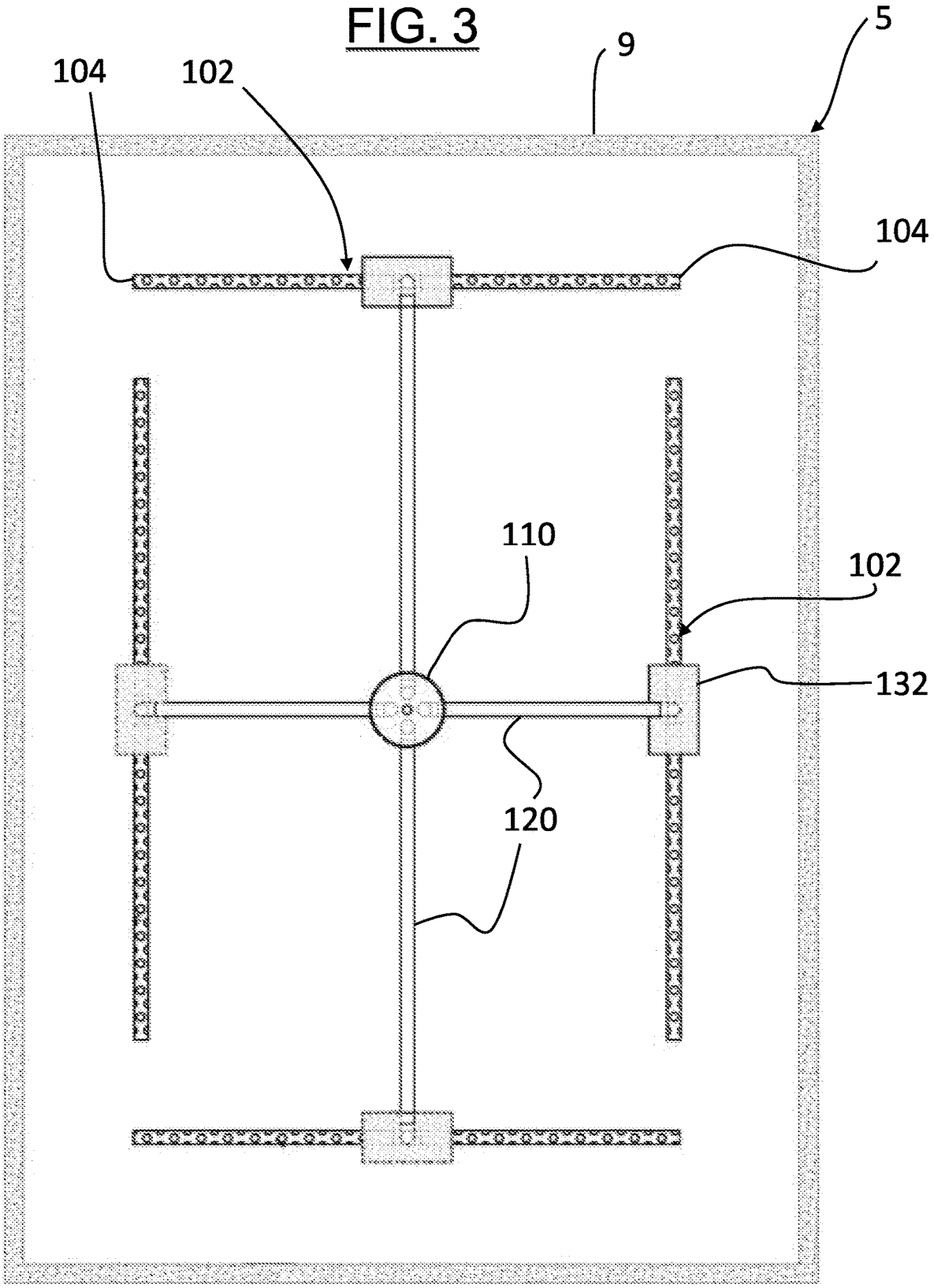
FIG. 3 is a plan view schematically showing the radon gas intakes, the manifold and interconnecting ducting of the system of FIG. 1.
Figure 4:
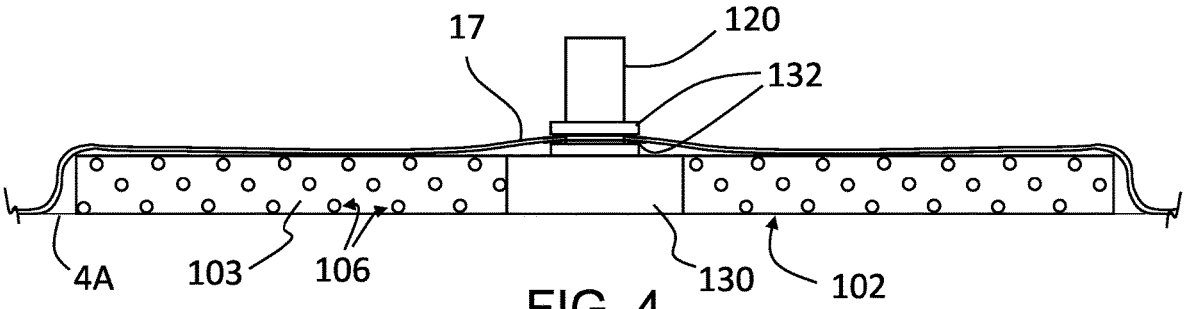
FIG. 4 is a partial elevational view of a radon gas intake of the arrangement of FIG. 1 disposed under a vapor barrier.
Figure 5:
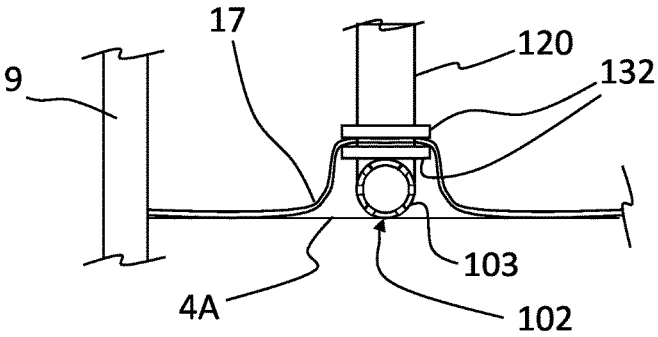
FIG. 5 is a partial elevational view of the radon gas intake of FIG. 4 but shown from an end thereof.
Figure 6:
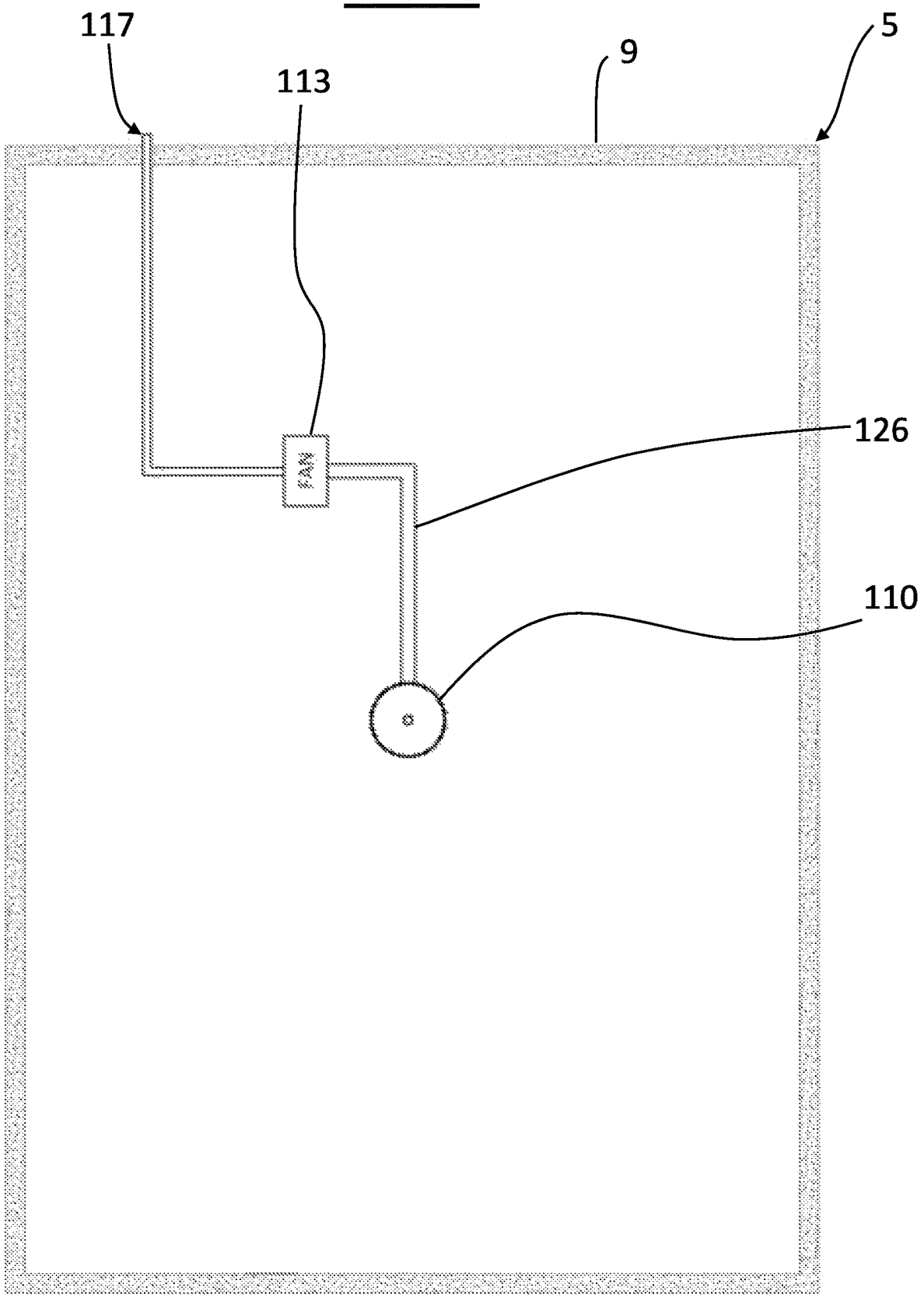
FIG. 6 is a schematic diagram of the manifold, the fan and the outlet of the system of FIG. 1.

As more clearly shown in FIGS. 2 and 3, the radon gas intakes 102 are arranged to be respectively registered with one of the walls 9 of the foundation and are collectively arranged to generally follow the building footprint 5. Each radon gas intake 102 is registered with one of the foundation walls 9 in that a distinct one of the radon gas intakes is provided in association with each one of the foundation walls, so that the radon gas intakes can collectively follow the building footprint 5. Generally speaking, the building footprint 5 is polygonal in shape, and each radon gas intake is associated with a distinct one of the sides of the footprint. Typically, distinct radon gas intakes 102 are not provided to follow a jog in the foundation, where the jog is virtually negligible to the overall polygonal shape of the footprint. A single radon gas intake may be provided to substantially span a respective one of the walls associated with a corresponding one of the sides of the footprint and a jog at a location on the same side of the footprint.

As more clearly shown in FIG. 3, the radon gas intakes 102 are arranged in spaced relation to the walls of the foundation, typically in the order of about four feet. Thus, the radon gas intakes 102 are positioned to draw gas on either side of the respective lengths of piping, that is an outer side of the intake between the intake and the closest foundation wall with which the intake is registered, and an inner side of the intake which is opposite from a diametrically opposite one of the intakes.

Further to the radon gas intakes, the system 100 comprises a manifold 110 arranged above the vapor barrier 17 so as to be within the building envelope, and the manifold 110 is in fluidic communication with the radon gas intakes 102.

With reference to FIG. 1, the system also includes a fan 113 arranged within the building envelope and in fluidic communication with the manifold 110. The fan 113 is configured to generate an airflow to draw the radon gas from the subterranean environment and to the manifold.

Additionally, and still referring to FIG. 1, the system 100 includes an outlet 117 arranged in the building 1 at a location thereon above the grade-defining surface 4B of the ground material. The outlet 117 is in fluidic communication with the fan 113 and configured to release the radon gas to an outside environment of the building envelope, that is an ambient environment. The outlet 117 is configured to release the drawn gas to the ambient environment.

Each radon gas intake 102 substantially spans a majority of a corresponding one of the foundation walls 9 with which it is registered. Typically, the radon gas intake 102 spans substantially a full length of the corresponding wall, where the length of the wall is measured between horizontally opposite ends of the wall; however, the (closed) ends 104 of the piping forming the radon gas intake are spaced from adjacent ones of the foundation walls relative to the respective one of the walls with which the radon gas intake is registered or associated. Typically, the ends 104 of the piping of the intake 102 are spaced from the adjacent walls by a common amount as the spacing of the intake from the wall with which it is registered, which in the illustrated arrangement is in the order of four feet.

Since each radon gas intake 102 is in the form of a length of piping, it is elongated and generally linear in shape. Thus, preferably, the piping of a respective one of the gas intakes is oriented substantially parallel to the foundation wall 9, with which the intake is registered or associated, in the lengthwise or longitudinal direction thereof.

The radon gas intakes 102 collectively generally follow the building footprint 5 in that the radon gas intakes, which are generally linear in shape, collectively form the same overall shape as the building footprint 5. Since it is preferred that the radon gas intakes 102 are disconnected from each other, as in the illustrated arrangement, a path formed thereby similar in shape to the building footprint is interrupted or discontinuous.

In the illustrated arrangement, and as more clearly shown in FIG. 3, the manifold 110 is in fluidic communication with each radon gas intake 112 independently. That is, respective ducting 120 is fluidically connected at one end thereof to each of the intakes 102 with the manifold 110.

In the illustrated arrangement, adjacent ones of the radon gas intakes registered with different ones of the walls of the foundation are arranged in spaced relation to one another.

In the illustrated arrangement, the manifold 110 is arranged substantially centrally of the building footprint such that suction generated by the fan 113 is substantially balanced or uniform amongst all of the radon gas intakes.

In the illustrated arrangement, the manifold 110 is arranged to be located in the crawlspace 14. For support within the crawlspace, the manifold 110 is mounted to an underside 20 of the floor 12, for example by one or more interconnecting brackets or hangers 123 which act to suspend the manifold from the floor 12.

In the illustrated arrangement, the fan 113 is arranged to be located outside the crawlspace 14, above the floor 12. Accordingly, ducting 126 between the manifold 110 and the fan 113 is disposed in the building envelope. This makes the fan 113 more readily accessible to an inspector to confirm it is operable.

Furthermore, the system 100 includes the respective ducting 120 from each of the radon gas intakes to the manifold and arranged to convey the drawn radon gas, and the respective ducting 120 extends upwardly from a respective one of the radon gas intakes and then substantially horizontally to the manifold. A horizontal portion 127A of the respective ducting that extends horizontally to the manifold is arranged to be supported by the floor, for example by hangers 129.

More specifically, the respective ducting 120 extends upwardly from a respective one of the radon gas intakes to be parallel in a height direction (between the top and bottom ends of) to the foundation wall with which the radon gas intake is registered, to provide an upward portion 127B of the ducting. After the upward portion of the ducting 127B, the ducting extends then substantially horizontally to the manifold so as to be substantially parallel to the floor. Preferably, the horizontal portion 127A of the ducting is adjacent to the floor 12 and closer to the floor than the below-grade ground surface 4B. Consequently, the crawlspace 14 is substantially unobstructed.

In the illustrated arrangement, the manifold 110 and the radon gas intakes 102 are arranged substantially symmetrically of the center of the building footprint 5 such that suction generated by the system 100 is substantially balanced or uniform amongst all of the radon gas intakes. The symmetry in this case is point symmetry about the center of the building footprint.

In the illustrated arrangement, opposite ones of the radon gas intakes, which are diametrically opposite each other, are substantially the same so that the system is substantially symmetrical on either side of a center of the building footprint.

The constituent components of the system 100 are typically provided as a kit for installation to form the system 100 which is then operative to transfer the trapped gas under the vapor barrier to the ambient environment of the building.

In the illustrated arrangement, the outlet 117 is formed by an open end of ducting fluidically connected to the fan 113 and disposed outside the building envelope. Preferably, this open end is covered with a screen configured to permit passage of gas but to mechanically obstruct debris from the ambient environment from entering the system 100. Preferably, the outlet 117 opens downwardly, so as to face the above-grade ground surface 4B, to resist entry of precipitation into the system 100.

The fan 113 is disposed downstream of the manifold relative to the direction of airflow from the subterranean environment and to the above-grade ambient environment. Accordingly, the fan 113 is also disposed downstream of the gas intakes, so as to generate a suction thereat.

This arrangement is particularly suited for removing radon gas from buildings with crawlspace, in particular crawlspaces under in-ground basements.

As described hereinbefore, the present invention relates to a radon gas mitigation system and kit for a building with a crawlspace which comprises a plurality of radon gas intakes arranged under a vapor barrier in the crawlspace to be in a subterranean environment and outside a building envelope. The intakes are arranged to be respectively registered with one of plural foundation walls and collectively arranged to generally follow the building footprint. The intakes are arranged in spaced relation to the foundation walls. A manifold is arranged in the building envelope and in fluidic communication with the intakes; a fan in the building envelope and in fluidic communication with the manifold and configured to generate an airflow to draw radon gas from the subterranean environment and to the manifold; and an outlet arranged in the building at a location above a grade of ground and in fluidic communication with the manifold and configured to release the radon gas to the outside.

The radon gas mitigation system is designed to limit radon and moisture entry from the crawl space thereby providing enhanced protection to both the occupants and the house.

Typically, the system 100 comprises four or more 2" diameter perforated hoses installed under the polyethylene moisture barrier normally installed on the crawlspace floor, which defines the below-grade ground surface 4A. These hoses, which define tubular peripheral walls 103 of the intakes 102, are connected to a central manifold 110, hung from the floor joists above constituent of floor 12, which is then connected to an exhaust fan 113 which can operate on an intermittent or continuous basis. By depressurizing the space between the polyethylene and the underlying soil, radon and moisture are inhibited from entering the crawl space and the occupied portions of the house.

Components of the system 100 include:

2" diameter perforated hoses
2" diameter tees
2" diameter solid hoses
2" diameter rubber connections
3" diameter solid pipes
3" diameter elbows
3" diameter rubber connections
Rubber mats A method of forming the system 100 from a kit of components comprises the following steps:

1. Form, in registration or association with each of the upstanding foundation walls 9, an opening in the vapor barrier in spaced relation to the respective foundation wall. For example, when the basement has a rectangular shaped footprint, make four cuts, each about 8" long, in the crawl space polyethylene moisture barrier. Each cut should be near the middle of the wall and approximately 4' from the crawl space wall.

2. Form each of the radon gas intakes 102. Typically, this is done by performing the following steps:
   - 2a. Insert two lengths of perforated hose, each about 10' long and capped at one end, through one of the slits so the perforated hoses run parallel to the foundation wall in the crawlspace.
   - 2b. At each slit, connect the open ends of the two perforated hoses to a 2" diameter tee 130.
   - 2c. Insert a 12"×12" rubber mat 132, with a 2" diameter hole in the middle, through the polyethylene so that the middle arm of the tee penetrates the 2" hole in the rubber mat. Glue the rubber mat to the underside of the polyethylene.
   - 2d. Install and glue a second rubber mat 132 on top of the first mat so that the polyethylene is sandwiched between the two mats. This acts to fluidically seal the vapor barrier to the system where the respective gas intake passes from the subterranean environment and into the building envelope. Each mat acts as a sandwich panel to enlarge a surface area of a sealing interface to be formed between the cut vapor barrier and the gas intake 102, specifically at the tee 130.
3. Fluidically connect respective ducting 120 to each of the gas intakes. Typically, this comprises installing a 2" diameter solid hose to the protruding end of each tee with a flexible rubber connection and metal hose clamp. Extend each solid hose to a central location in the crawl space where the manifold is to be located.
4. Install an exhaust blower 113, in other words a fan. Preferably, the fan is installed in the basement above the floor 12, so as to be more readily accessible. Alternatively, the fan is installed in a central location in the crawl space, suspending it from the floor joists.
5. Install the central manifold, which can also be suspended from the floor joists.
6. Connect each of the four 2" diameter solid hoses to the manifold. That is, the solid hoses have imperforate tubular walls, unlike the tubular walls of the piping of the radon gas intakes.
7. Connect the manifold to the inlet side of the exhaust blower. Typically, this is done by a 3" duct or pipe, such that it is larger in diameter than ducting from the gas intakes to the manifold. When the blower is located outside the crawlspace (but within the building envelope, this includes drilling a hole in the floor 12 to pass the interconnecting ducting between the manifold and the blower.
8. Install a 2" diameter exhaust line from the blower to a suitable location in the building above the grade-defining ground surface 4B to form an outlet of the system for release of the drawn or collected gas outside the building envelope.
9. Install a 2" backdraft damper in the exhaust line close to the exhaust or discharge or outlet of the system, downstream of the blower 113. This acts to substantially prevent airflow from the ambient environment and towards the manifold.
10. Connect the blower, with timer if desired, to an electrical supply, typically 120 V.

The scope of the claims should not be limited by the preferred embodiments set forth in the examples but should be given the broadest interpretation consistent with the specification as a whole.

The invention claimed is:

1. A radon gas mitigation system for use in a building, wherein the building has an in-ground foundation configured to be supported by ground material and defining a building footprint, wherein the building includes an enclosed structure supported on the foundation, wherein the foundation has a plurality of upstanding walls with bottom ends disposed below a below-grade surface of the ground material within the building footprint and top ends of the walls disposed above a grade-defining surface of the ground material outside the building footprint, wherein the building includes a substantially horizontal floor supported by the foundation adjacent to and at a spaced height above the below-grade surface, wherein the floor forms a crawlspace thereunder and between the foundation walls and the below-grade surface of the ground material, wherein the building further includes a vapor barrier in the crawlspace and arranged in contact with the ground material to form a subterranean environment under the vapor barrier and a substantially enclosed building envelope thereabove, the radon gas mitigation system comprising:

a plurality of radon gas intakes arranged under the vapor barrier so as to be disposed in the subterranean environment, wherein each radon gas intake is in the form of a length of piping having a tubular peripheral wall and extending between first and second ends, wherein the first and second ends are closed, wherein the peripheral wall has a plurality of openings configured to permit passage of fluid into the piping;

wherein the radon gas intakes are arranged to be respectively registered with one of the walls of the foundation and are collectively arranged to generally follow the building footprint, and wherein the radon gas intakes are arranged in spaced relation to the walls of the foundation;

a manifold arranged above the vapor barrier so as to be within the building envelope, wherein the manifold is in fluidic communication with the radon gas intakes;

a fan arranged within the building envelope and in fluidic communication with the manifold, wherein the fan is configured to generate an airflow to draw the radon gas from the subterranean environment and to the manifold; and an outlet arranged in the building at a location thereon above the grade-defining surface of the ground material, wherein the outlet is in fluidic communication with the fan and configured to release the radon gas to an outside environment of the building envelope.

2. The radon gas mitigation system of claim 1 wherein the manifold is arranged to be located in the crawlspace.

3. The radon gas mitigation system of claim 2 wherein the manifold is arranged to be mounted to an underside of the floor.

4. The radon gas mitigation system of claim 1 wherein the manifold is arranged substantially centrally of the building footprint.

5. The radon gas mitigation system of claim 1 wherein the fan is arranged to be located outside the crawlspace.

6. The radon gas mitigation system of claim 1 wherein, when the manifold is located in the crawlspace and the system further includes respective ducting from each of the radon gas intakes to the manifold and arranged to convey the drawn radon gas, the respective ducting extends upwardly from a respective one of the radon gas intakes and then substantially horizontally to the manifold.

7. The radon gas mitigation system of claim 6 wherein a horizontal portion of the respective ducting that extends horizontally to the manifold is arranged to be supported by the floor.

8. The radon gas mitigation system of claim 1 wherein the manifold and the radon gas intakes are arranged substantially symmetrically of a center of the building footprint.

9. The radon gas mitigation system of claim 1 wherein opposite ones of the radon gas intakes are substantially the same.

10. A radon gas mitigation kit for use in a building, wherein the building has an in-ground foundation configured to be supported by ground material and defining a building footprint, wherein the building includes an enclosed structure supported on the foundation, wherein the foundation has a plurality of upstanding walls with bottom ends disposed below a below-grade surface of the ground material within the building footprint and top ends of the walls disposed above a grade-defining surface of the ground material outside the building footprint, wherein the building includes a substantially horizontal floor supported by the foundation adjacent to and at a spaced height above the below-grade surface, wherein the floor forms a crawlspace thereunder and between the foundation walls and the below-grade surface of the ground material, wherein the building further includes a vapor barrier in the crawlspace and arranged in contact with the ground material to form a subterranean environment under the vapor barrier and a substantially enclosed building envelope thereabove, the radon gas mitigation kit comprising:

a plurality of radon gas intakes arranged to be disposed under the vapor barrier so as to be disposed in the subterranean environment, wherein each radon gas intake is in the form of a length of piping having a tubular peripheral wall and extending between first and second ends, wherein the first and second ends are closed, wherein the peripheral wall has a plurality of openings configured to permit passage of fluid into the piping;

wherein the radon gas intakes are arranged to be respectively registered with one of the walls of the foundation and are collectively arranged to generally follow the building footprint, and wherein the radon gas intakes are arranged to be in spaced relation to the walls of the foundation;

a manifold arranged to be disposed above the vapor barrier so as to be within the building envelope, wherein the manifold is arranged to be in fluidic communication with the radon gas intakes;

a fan arranged to be within the building envelope and in fluidic communication with the manifold, wherein the fan is configured to generate an airflow to draw the radon gas from the subterranean environment and to the manifold; and an outlet arranged to be disposed in the building at a location thereon above the grade-defining surface of the ground material, wherein the outlet is arranged to be in fluidic communication with the fan and configured to release the radon gas to an outside environment of the building envelope.

11. The radon gas mitigation kit of claim 10 wherein the manifold is arranged to be located in the crawlspace.

12. The radon gas mitigation kit of claim 11 wherein the manifold is arranged to be mounted to an underside of the floor.

13. The radon gas mitigation kit of claim 10 wherein the manifold is arranged to be located substantially centrally of the building footprint.

14. The radon gas mitigation kit of claim 10 wherein the fan is arranged to be located outside the crawlspace.

15. The radon gas mitigation kit of claim 10 wherein the kit further includes ducting arranged to extend from each of the radon gas intakes to the manifold to convey the drawn radon gas, the ducting being arranged to be located in the crawlspace such that the ducting extends upwardly from a respective one of the radon gas intakes and then substantially horizontally to the manifold.

16. The radon gas mitigation kit of claim 15 wherein the ducting is arranged to extend from each of the radon gas intakes includes a horizontal portion arranged to extend horizontally to the manifold and arranged to be supported by the floor.

17. The radon gas mitigation kit of claim 10 wherein the manifold and the radon gas intakes are arranged to be located substantially symmetrically of a center of the building footprint.

18. The radon gas mitigation kit of claim 10 wherein the radon gas intakes are arranged such that opposite ones of the radon gas intakes are substantially the same.

* * * * *